United States Patent [19]

Tesone

[11] Patent Number: 4,848,118

[45] Date of Patent: Jul. 18, 1989

[54] LOCK HOLD-BACK LATCH WITH ANTI-PICK DEVICE

[75] Inventor: Jeffrey M. Tesone, Rialto, Calif.

[73] Assignee: Adams Rite Manufacturing Co., City of Industry, Calif.

[21] Appl. No.: 72,289

[22] Filed: Jul. 13, 1987

[51] Int. Cl.[4] ..... E05B 17/20

[52] U.S. Cl. ..... 70/419; 292/169.13; 292/169.17; 292/346

[58] Field of Search ..... 70/418, 419; 292/169.13, 169.14, 346, 169.17, 169.15, 169.16

[56] References Cited

U.S. PATENT DOCUMENTS

| | | | |
|---|---|---|---|
| 19,628 | 3/1858 | Denney | 70/419 |
| 23,113 | 3/1859 | Powers | 70/419 |
| 583,222 | 5/1897 | Bartl | 292/346 |
| 698,811 | 4/1902 | Carleton | 292/346 |
| 1,195,713 | 8/1916 | Page | 70/418 |
| 1,229,335 | 6/1917 | Shaw | 70/418 |
| 1,239,188 | 9/1917 | Kohlberger | 292/346 |
| 1,250,996 | 12/1917 | Eldridge | 70/418 |
| 1,275,938 | 8/1918 | Juselius | 292/346 |
| 1,774,682 | 9/1930 | Van Dooren | 292/169.16 |
| 1,794,055 | 2/1931 | Benson | 70/134 |
| 2,098,189 | 11/1937 | Kistner | 70/134 |
| 2,107,299 | 2/1938 | Kilpatrick | 70/418 |
| 2,218,685 | 10/1940 | Ross | 70/418 |
| 2,350,306 | 5/1944 | Spain | 70/418 |
| 2,407,775 | 9/1946 | Frost | 292/169.17 |
| 2,503,192 | 4/1950 | Cerf, Jr. | 292/169.17 X |
| 2,730,391 | 1/1956 | Rayburn | 292/169.13 |
| 2,814,196 | 11/1957 | Frank | 70/418 |
| 3,073,143 | 1/1963 | Eads | 292/169.13 X |

FOREIGN PATENT DOCUMENTS

| | | | |
|---|---|---|---|
| 1143747 | 2/1969 | United Kingdom | 292/169.14 |
| 1572366 | 7/1980 | United Kingdom | 292/169.13 |

*Primary Examiner*—Lloyd A. Gall

*Attorney, Agent, or Firm*—William W. Haefliger

[57] ABSTRACT

Disclosed is an improvement in the lock mechanism described in U.S. Pat. No. 3,073,143. The improvement comprises barrier walls on the bolt which prevent a shim-type pick device from opening the lock mechanism. The barrier walls are positioned to prevent the pick device from tripping the locking member which locks the deadlock actuator in the locked position.

2 Claims, 4 Drawing Sheets

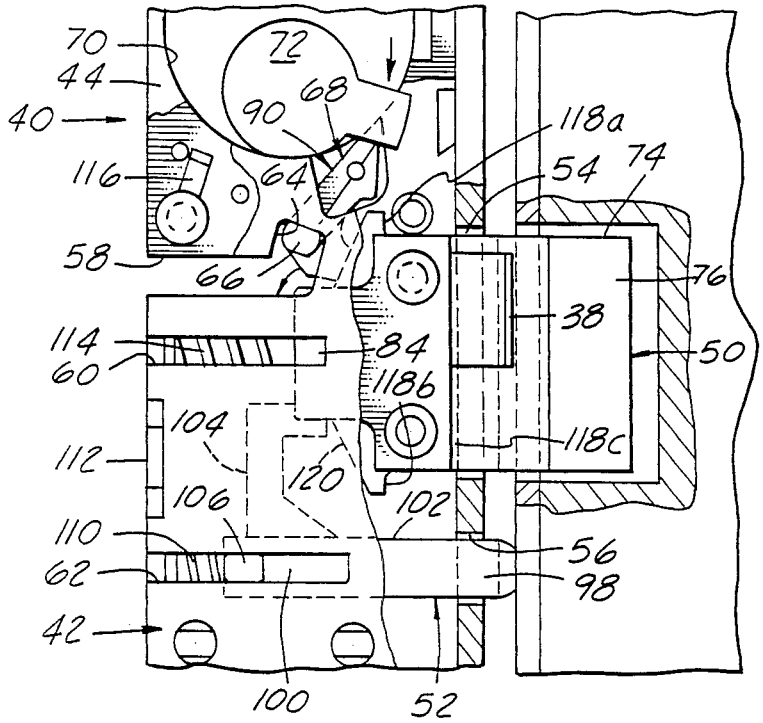
FIG. 8
FIG. 9
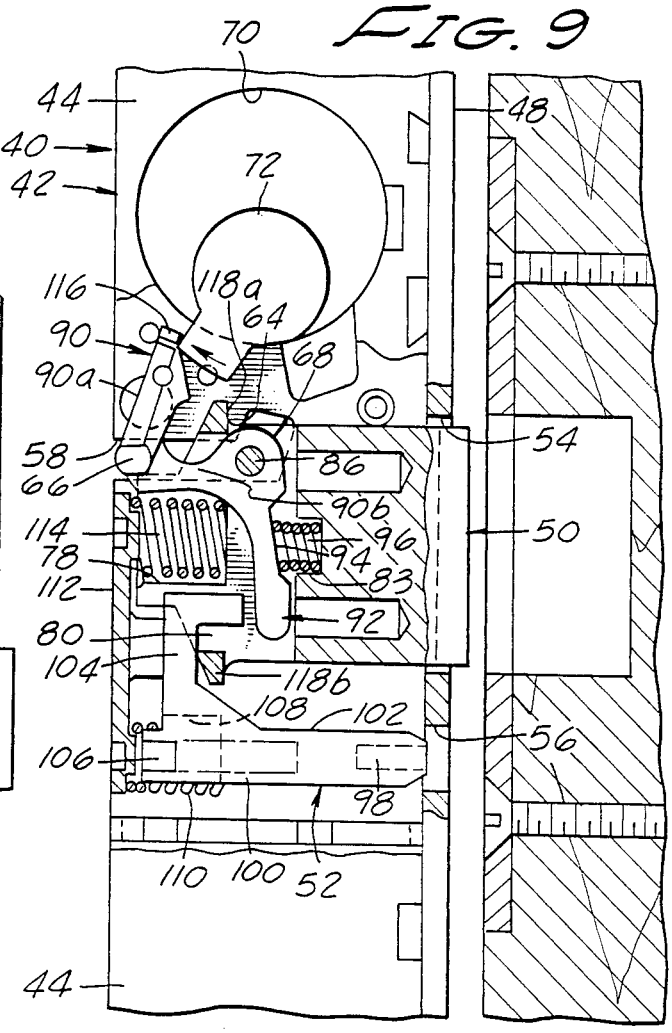
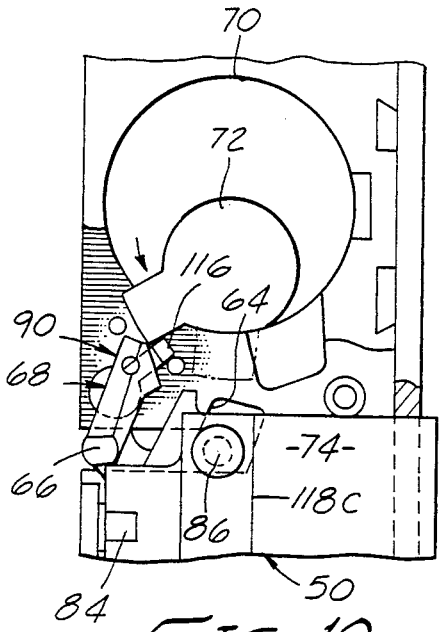
FIG. 10

LOCK HOLD-BACK LATCH WITH ANTI-PICK DEVICE

BACKGROUND OF THE INVENTION

1. Field of the Invention:

This invention relates to lock mechanisms, and particularly a door lock mechanism equipped with an anti-pick device.

2. Background Discussion:

A deadlocking latch is described in U.S. Pat. No. 3,073,143 which provides a lock mechanism wherein a spring actuated bolt is deadlocked in a locked position and manually unlocked using a key control member. This deadlocking latch has been a widely accepted lock mechanism and has been used in a variety of applications. One disadvantage of this lock mechanism is that it may be picked by inserting a shim between the bolt and an opening in the lock casing to disengage the bolt by forcing a pin that projects laterally into the casing side.

SUMMARY OF THE INVENTION

The present invention is an improvement in the deadlocking latch described in U.S. Pat. No. 3,073,143 and it includes a barrier wall means integral with the bolt that blocks a shim-type lockpick. Without limiting the scope of the invention, as expressed by the claims, its more prominent features will now be discussed briefly. After considering this discussion, particularly after reading the section of this application entitled DETAILED DESCRIPTION OF THE PREFERRED EMBODIMENT, one will understand how the anti-pick feature of this invention prevents picking the deadlocking latch with a shim-type lock pick.

The door latch described in U.S. Pat. No. 3,073,143 includes a casing having a faceplate, a latch bolt, a locking member cooperating with the latch bolt to lock it in position, and a deadlock actuator. The latch bolt and deadlock actuator are movable within the casing between extended and retracted positions. The deadlock actuator engages the locking member when it is in the extended position. When the deadlock actuator is retracted, the pivotably mounted locking member moves from an unlocked to a locked position. The locking member, latch bolt, and deadlock actuator each have pins means extending laterally into guide slots in the casing. A shim-type lock pick inserted through an opening in the faceplate and into the casing can engage the pin of the locking member to move the locking member to the unlocked position. The present invention prevents this from happening.

The principal feature of this invention is the use of a bolt member with barrier wall means associated therewith that prevents a shim type lock pick from disengaging the locking member of the latch. Typically the bolt member has a generally rectangular cross-section and there will be a barrier wall disposed forward of guide slots in the casing between the pins and the opening in the faceplate. These walls are of sufficient height to stop a shim from moving into the casing to a point where it would engage the pin of the locking member.

The preferred embodiment of this invention illustrating all its features will now be discussed in detail. This embodiment shows a typical deadlatch having a bolt equipped with barrier wall means of this invention.

BRIEF DESCRIPTION OF THE DRAWING

The improved latch of this invention is illustrated in the drawing, with like numerals indicating like parts, and in which:

FIG. 8 is an enlarged fragmentary vie showing the improved latch of the present invention about to be opened by moving the locking member with the key control element.

FIG. 9 is an enlarged fragmentary view of the improved latch of the present invention opened by the key control element.

FIG. 10 is an enlarged fragmentary view showing the locking member being held in the unlocked position by a holdback retainer.

DESCRIPTION OF THE PREFERRED EMBODIMENT

Figures 1, 2:
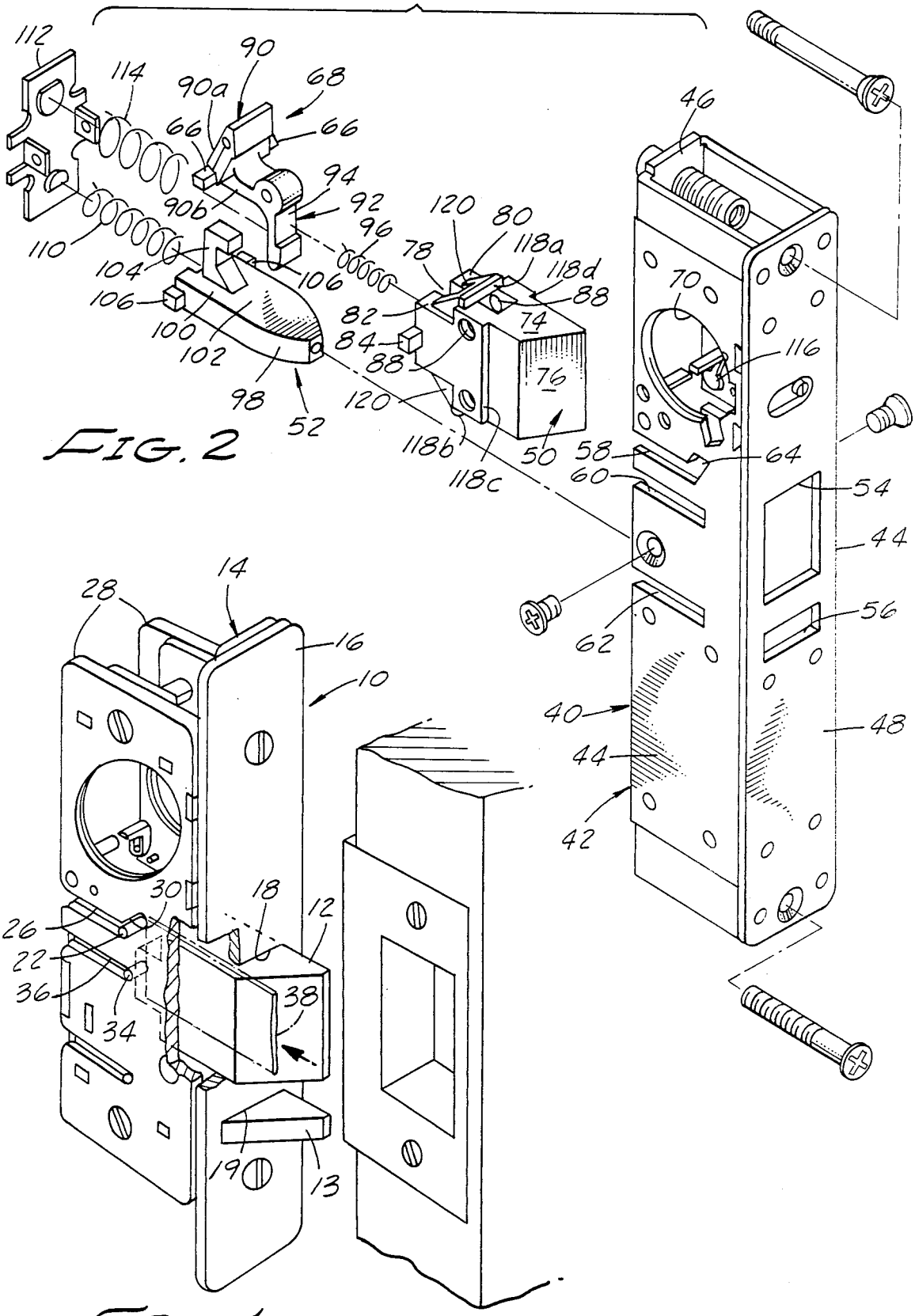
FIG. 1 PRIOR ART
FIG. 1 is a perspective view showing the conventional deadlocking latch being picked with a shim-type lockpick.
FIG. 2 is an exploded perspective view of the improved deadlatch of this invention.
Figure 3:
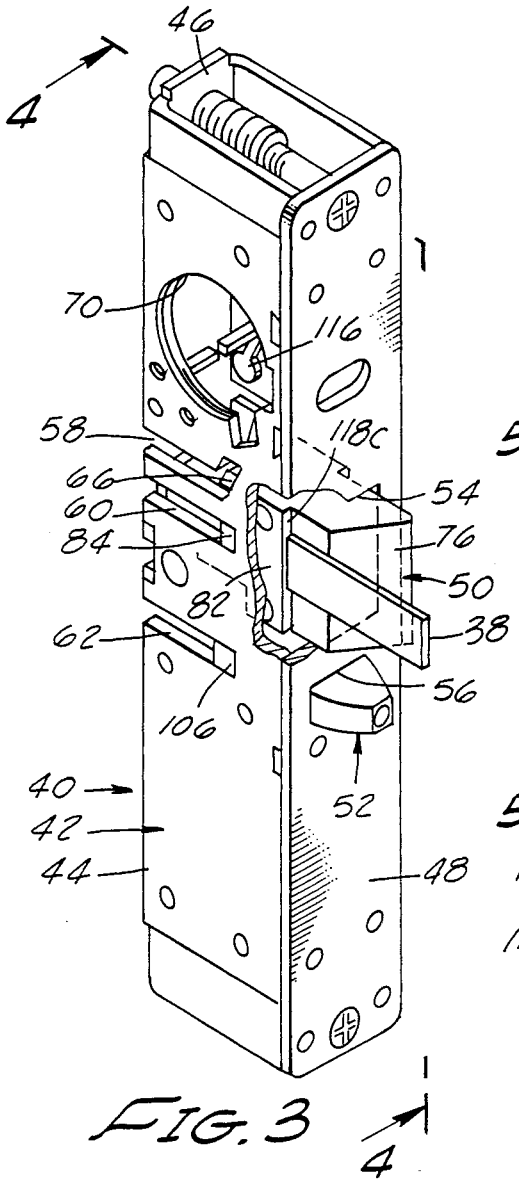
FIG. 3 is a perspective view of the improved latch of this invention, with sections broken away, showing the bolt member equipped with a barrier wall that prevent the shim-type lockpick from opening the latch.

As illustrated in FIG. 1 a conventional lock deadlatch 10 includes a bolt 12 and deadlock actuator 13 which are slidably movable in a casing 14 having a faceplate 16 with a pair of rectangular openings 18 and 19 therein to receive, respectively, the bolt and the deadlock actuator. As illustrated in U.S. Pat. No. 3,073,143, the conventional latch 10 includes a locking element 20 (not shown), similar to the locking element shown in FIG. 2. This locking element includes a pair of pins 22 which project laterally from the side of the element into a pair of guide slots 26 (only one shown) in opposed side plates 28 of the casing 14. The ends of the slots 26 terminating in the side plates 28 have upwardly projecting notches 30 in which the pins 22 are received when the locking element is in the locked position. In a like fashion, the bolt 12 has a pair of pins 34 projecting laterally from opposite sides of the bolt. These pins 34 are also received in slots 36 in opposed side plates 28.

As depicted in FIG. 1, if a shim 38 is inserted through the opening 18 in the faceplate 16 along the side of the bolt 12, it can be forced inwardly to engage the pins 22 and 34. As the shim 38 is moved inwardly, it will push the pins 22 and pins 34 along, respectively the guide slots 26 and 36 to move the latch 10 from the locked to the unlocked position. It is this undesirable aspect of the latch 10 that the present invention overcomes.

As best shown in FIGS. 2, 3, 4 and 11, improved lock mechanism 40 of the present invention includes a casing 42 having a pair of side plates 44 separated by end brackets 46. A faceplate 48 is secured to the edges of the side plates 44 and brackets 46 to provide the generally box-like casing 42 which receives a bolt 50 and deadlock actuator 52. The bolt 50 and actuator 52, respectively, project through rectangular openings 54 and 56 in the face plate 48. The side plates each include guide slots 58, 60, and 62. The guide slot 58 has a notch 64 at one end for receiving the laterally extending pin 66 of a locking element 68. At the upper ends of the side plates 44 is a generally circular opening 70 into which the key controlled cam 72 is housed. This key controlled cam 72 is used to move the locking element 68 between locked and unlocked positions in response to the turning of a key (not shown).

Figure 11:
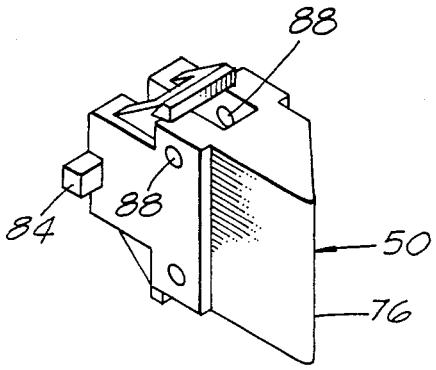
FIG. 11 is a perspective view of the latch bolt employed with the latch of this invention.

As best shown in FIG. 11, the bolt 50 includes a body member 74 having an outwardly projecting beveled camming surface 76 which extends through the opening 54. The rear section of the body member 74 has a recess 78 therein formed by two rearwardly projecting walls 80 and 82. A pair of laterally projecting pins 84 extend outwardly from these walls into the guide slots 60 in the side plates 44. As best shown in FIG. 7, the recess 78 has two offset sections 78*a* and 78*b* to provide a ledge 81. At the rear wall of recess section 78*b* is a central bore 83. The locking element 68 is received within the recess 78 between the walls 80 and 82 and is pivotally mounted to the body member 74 by a rod 86 (FIG. 6) which extends through aligned holes 88 in the body member.

As shown in FIGS. 1, 6, 7 and 10, the locking element 68 has two outwardly projecting arms 90 and 92. Arm 90 has a generally L-shaped configuration with the two outwardly projecting pins 66 extending laterally at the intersection between the legs 90*a* and 90*b*. The downwardly projecting arm 92 is at right angles to the one leg 90*b*. This arm 92 extends into recess section 78 and it has offset 94 therein which receives a coiled compression spring 96 that will normally bias the locking element 68 in a clockwise direction as viewed in FIG. 4. The spring 96 is seated in the bore 83.

The deadlock actuator 52 includes a camming end 98 which projects through the rectangular opening 56 in the faceplate 48 and a rear body section 100 including a generally flat top 102 having a centrally located hooked finger 104 projecting upwardly from the top and a pair of opposed pins 106 extending laterally from the side of the actuator. A central cavity 108 in the rear body section 100 receives a coiled spring 110. This spring 110 forces the actuator 52 into the extended position shown in FIG. 4.

Figure 4:
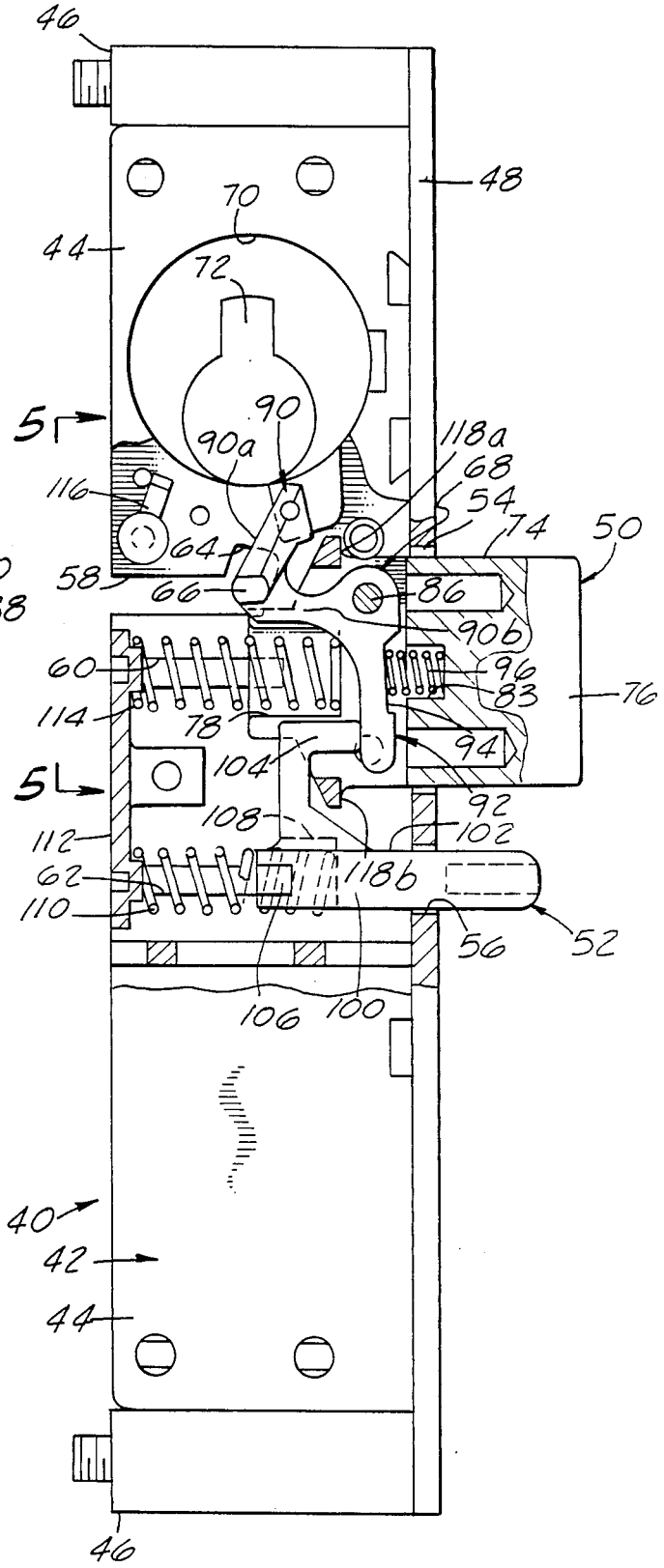
FIG. 4 is a side elevational view of the latch of the present invention, with sections broken away, showing both the bolt and deadlock actuator in extended positions.
Figure 6:
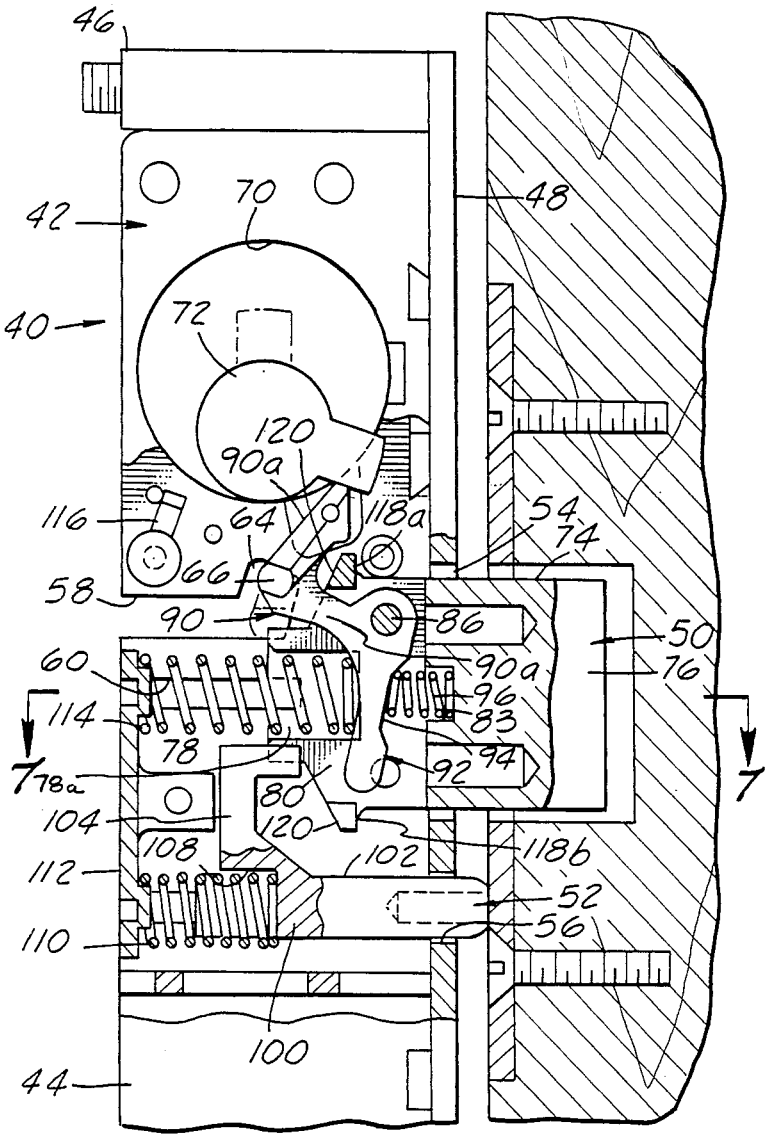
FIG. 6 is an enlarged fragmentary view showing the improved latch of the present invention in a locked position with the bolt member in an opening in the strike plate of a door.
Figure 5:
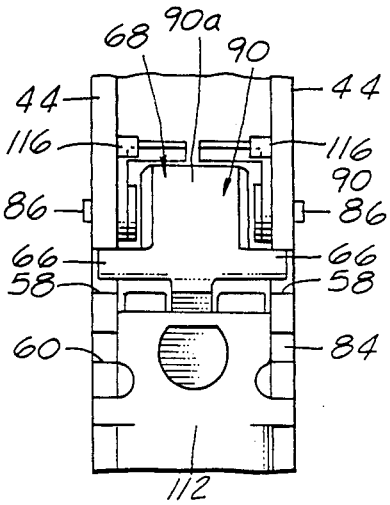
FIG. 5 is a cross-sectional view taken along line 5—5 of FIG. 4.
Figure 7:
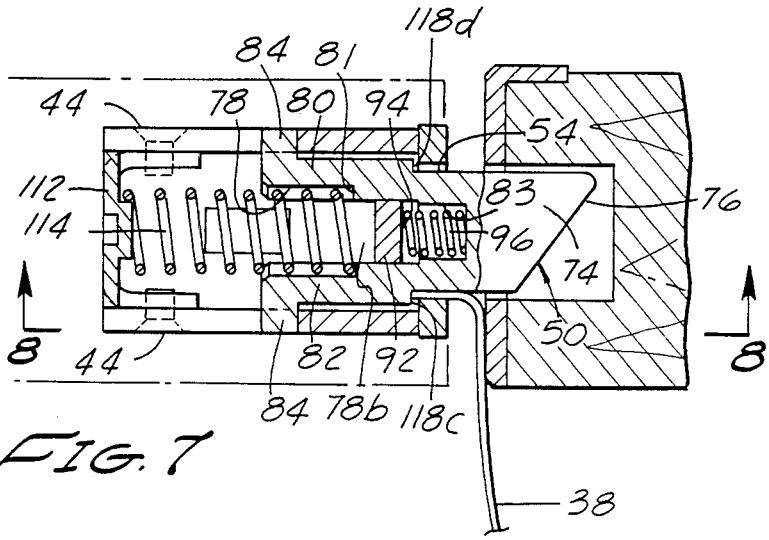
FIG. 7 is a cross-sectional view taken along line 7—7 of FIG. 6.

As best shown in FIGS. 1, 5 and 6, the actuator 52 and locking element 68 are held in position by retaining plate 112 carried by the casing 42. A coiled compression spring 114 seated partially in recess section 78*a* normally presses against the exterior of the arm 92 to force the locking element 68 to rotate in a counterclockwise direction as viewed in FIG. 6. The retaining plate 112 is removably secured to the side plates 44 to hold the coiled springs 110 and 114 in position as shown in FIG. 4. With the deadlock actuator 52 in the extended position, the hooked finger 104 engages the arm 92, rotating the locking element 68 in a counterclockwise direction as viewed in FIG. 4 to move the pins 66 from the notch 64. With the deadlock actuator 52 moved to the retracted position upon closure of the door, as viewed in FIG. 6, the locking element 68 rotates in a clockwise direction under the force of the spring 96 to move the pins 66 into the notch 64 to lock the bolt 50 into position. The bolt 50 can move inwardly when the locking element 68 is unlocked by turning the key controlled cam 72 in a clockwise direction as viewed in FIGS. 8, 9 and 10. Rotating the cam 72 in a counterclockwise direction, as viewed in FIG. 10, will bring the cam into engagement with a retainer element 116 to hold the end of the locking element 68 in the position shown in FIG. 10.

In accordance with the characterizing feature of the present invention, the bolt 50 includes barrier walls 118*a* through 118*d* on each of its sides to prevent the shim-type pick 38 from being inserted through the opening 54 between the bolt 50 and the faceplate 48 and side plates 44 as illustrated in FIG. 7. The walls 118*a* and 118*b* are provided by a pair of opposed wedge-shaped members 120 which are integral with the bolt 50. The leg of the arm 90*a* is sufficiently long to extend up and over the top barrier wall 118*a* as shown in FIG. 6 so that it may engage the cam 72 of the key controlled lock. The camming end of the bolt 50 is offset inwardly slightly to provide two side barrier walls 118*c* and 118*d*. These barrier walls 118*a* through 118*d* are all forward of the pin elements 66, 84 and 106 of the locking element 68, bolt 50 and deadlock actuator 52, respectively. Consequently, the shim 38, which has a thickness approximately equal to or less than the barrier walls 118*a* through 118*d*, ordinarily 1/64 inch, will not slip past these walls. By carefully controlling the dimensions of the opening 54 and bolt 50 so that there is a tight fit between the bolt camming end and the opening, only a very thin shim, will pass through this space between the opening and camming end. Thus, this thin shim 38 will then engage a barrier wall 118*a* through 118*d* which is about as thick or thicker than the shim, preventing the shim from picking the locking mechanism 40.

SCOPE OF THE INVENTION

The above description presents the best mode contemplated of carrying out the present invention. This invention is, however, susceptible to modifications and alternate constructions from the embodiment shown in the drawing and described above. Consequently, it is not the intention to limit this invention to the particular embodiment disclosed. On the contrary, the intention is to cover all modifications and alternate constructions coming within the spirit and scope of the invention as expressed by the claims.

I claim:

1. A lock mechanism comprising a casing including a faceplate having an opening therein, a latch bolt having a camming end portion horizontally movable forwardly and rearwardly within the casing so that said end portion moves between a first position extending outwardly from the casing through said opening and a second position withdrawn inwardly into said casing, said camming end portion and the opening fitting snugly to provide a narrow gap between said end portion and the faceplate, said latch bolt having four barrier walls on all four sides respectively of the latch bolt that serve to prevent a shim-type lockpick device being inserted along any side of said latch bolt through the opening in the faceplate and along the casing, a deadlock actuator movable horizontally forwardly and rearwardly within the casing below the bolt and between extended and retracted positions, and a rotary locking member carried by the latch bolt for engaging the deadlock actuator, the locking member projecting upwardly rearwardly of the uppermost of said barrier walls, for engagement by a key controlled element and the deadlock actuator projecting upwardly rearwardly of the lowermost of said barrier walls in order to engage said locking member.

2. In a lock mechanism having a casing and a faceplate, a latch bolt having a camming end portion protruding through an opening in the faceplate and movable horizontally forwardly and rearwardly within the casing between extended and retracted positions, a locking member mounted for pivotal movement within the casing and about a horizontal axis, said locking member having a first arm extending upwardly and adapted to engage a key controlled element for moving the locking member between locked and unlocked positions, and a second arm extending downwardly, a deadlock actuator movable forwardly and rearwardly within the casing between extended and retracted positions, the actuator having a finger which in the extended position of the deadlock actuator engages the locking member, said locking member, latch bolt, and deadlock actuator having pin means extending laterally into guide slots in the casing, the improvement wherein (a) the latch bolt has upper and lower horizontal surfaces and other laterally spaced, upright sides, and includes forwardly facing barrier wall means forward of the guide slots and extending around the perimeter of the latch bolt to define planes that intersect planes defined by said upper and lower surfaces and said lateral sides, and that serve to prevent a shim-type lockpick device being inserted along any of said surfaces or sides of said latch bolt through the opening in the faceplate and along the casing to force the locking member to disengage, said wall means including upper and lower walls and (b) the first arm projecting upwardly rearwardly of said wall means upper wall, (c) the said finger projecting upwardly rearwardly of said wall means lower wall, the said finger having upper extent facing openly forwardly toward said second arm above said wall means lower wall, (d) and wherein in extended position of the bolt, the deadlock actuator finger projects over the wall means lower wall and the locking member first arm projects upwardly rearwardly of the wall means upper wall, and (e) in retracted position of the bolt, the deadlock actuator finger is retracted to a position spaced rearwardly of the wall means lower wall, and the locking member first arm is rotated to extend over the wall means upper wall.

* * * * *